US007137421B2

(12) United States Patent
Biller

(10) Patent No.: US 7,137,421 B2
(45) Date of Patent: Nov. 21, 2006

(54) CHIPPER KNIFE

(75) Inventor: Sven-Olov Biller, Hudiksval (SE)

(73) Assignee: Iggesund AB, Iggesund (SE)

( * ) Notice: Subject to any disclaimer, the term of this patent is extended or adjusted under 35 U.S.C. 154(b) by 0 days.

(21) Appl. No.: 10/518,357

(22) PCT Filed: Jun. 11, 2003

(86) PCT No.: PCT/SE03/00959

§ 371 (c)(1),
(2), (4) Date: Mar. 7, 2005

(87) PCT Pub. No.: WO04/000514

PCT Pub. Date: Dec. 31, 2003

(65) Prior Publication Data

US 2005/0166998 A1 Aug. 4, 2005

(30) Foreign Application Priority Data

Jun. 19, 2002 (SE) ..... 0201865

(51) Int. Cl.
*B27C 1/00* (2006.01)
*B27C 5/00* (2006.01)
*B27G 13/00* (2006.01)

(52) U.S. Cl. ..... 144/241; 144/172; 144/176; 144/235; 407/113

(58) Field of Classification Search ..... 144/220, 144/241, 235, 230, 3.1, 162.1, 172, 174, 144/176; 407/113; 241/91, 92, 93, 296
See application file for complete search history.

(56) References Cited

U.S. PATENT DOCUMENTS 478,381 A * 7/1892 Taft ..... 144/241
1,700,787 A * 2/1929 Eckersley ..... 144/176

(Continued)

FOREIGN PATENT DOCUMENTS

SE 419522 8/1981

*Primary Examiner*—Bena Miller
(74) *Attorney, Agent, or Firm*—Fitzpatrick, Cella, Harper & Scinto

(57) ABSTRACT

The invention relates to a chipper knife with at least one cutting edge (6) along at least one of its side edges. The chipper knife is adapted to be mounted in chippers of the kind which are used to cut chips of a desired size and shape from pieces of wood or timber (7) and which comprise a tool, in the form of a plane or conical disc, which is arranged for rotation about an axis of rotation and on which a plurality of such chipper knifes (2) are mountable in such manner that one end of the cutting edge of the chipper knife is located closer to the axis of rotation of the tool than the opposite end of the cutting edge. The cutting edge (6) of the chipper knife is formed between a timber-guiding surface and a chip-guiding surface, the timber-guiding surface having a varying angle along its length in relation to a plane of rotation in such a way that the angle is greater at the end of the cutting edge located closest to the axis of rotation decreases in the outward direction. The chip-guiding surface of the chipper knife also has a varying angle along its length in relation to a plane of rotation in such a way that the angle is smaller at the end of the cutting edge located closest to the axis of rotation and increases in the outward direction in order to obtain a cutting edge angle between the timber-guiding surface and the chip-guiding surface (13) that is essentially constant along the whole length of the cutting edge.

10 Claims, 2 Drawing Sheets

U.S. PATENT DOCUMENTS 2,183,224 A * 12/1939 Norman ..... 241/92
2,385,750 A * 9/1945 Weddell ..... 407/38
2,776,687 A * 1/1957 Clark ..... 144/375
3,461,931 A * 8/1969 Wexell ..... 144/162.1
4,271,882 A * 6/1981 Valo ..... 144/241
4,569,380 A * 2/1986 Arasmith ..... 144/172
4,796,818 A * 1/1989 Thoma ..... 241/85
4,977,937 A * 12/1990 Hessenthaler ..... 144/241
5,129,437 A * 7/1992 Nettles et al. ..... 144/176
5,782,278 A * 7/1998 Larsson ..... 144/220
5,915,429 A * 6/1999 Pelletier et al. ..... 144/39
6,484,770 B1 * 11/2002 Jonkka ..... 144/373

* cited by examiner

CHIPPER KNIFE

This is a national phase entry of PCT/SE2003/000959 filed Jun. 11, 2003.

The present invention relates to a chipper knife comprising a cutting edge along at least one of its side edges, the chipper knife being adapted to be mounted in chippers of the kind which are used to cut chips of a desired size and shape from pieces of wood or timber and which comprise a tool, in the form of a plane or conical disc, which is arranged for rotation about an axis of rotation and on which a plurality of such chipper knifes are mountable, their respective cutting edges being oriented in the direction of rotation in such manner that one end of the cutting edge of the chipper knife is located closer to the axis of rotation of the tool than the opposite end of the cutting edge, the cutting edge of the chipper knife being formed between two surfaces, viz. a timber-guiding surface, which faces the pieces of timber fed to the tool, and a chip-guiding surface, which guides the cut chips through openings provided therefor in the tool, and the timber-guiding surface of the chipper knife having a varying angle along its length in relation to a plane of rotation in such a way that the angle is greater at the end of the cutting edge located closest to the axis of rotation and decreases in the outward direction to allow the timber-guiding surface to follow as closely as possible an ideal timber-guiding cam curve between two consecutive chipper knifes.

BACKGROUND ART

To obtain chips of uniform length in a chipping process, it is important to ensure smooth and uniform feeding of the pieces of timber to be cut between two consecutive chipper knives. The feeding of the timber can, at least to some degree, be controlled by a timber feeding device, but also by the timber-guiding surface formed between two chipper knives, which surface should follow an ideal cam curve for optimal guiding of the pieces of timber. The timber-guiding surface is formed on the one hand by a timber-guiding surface of the chipper knife forming a cutting edge and, on the other hand, by the outside of an outer clamping member, if any, but may also, in some types of machines, comprise a timber-guiding surface on the chipper disc between two consecutive chipper knives.

For chippers of the kind referred to above, in which the rotating tool has the shape of an essentially plane or conical disc and the respective chipper knives thus have a radial extension and are arranged with one end of the processing cutting edge closer to the axis of rotation of the disc than the opposite end, this means that the ideal cam curve will have a different shape or angle relative to the direction of rotation depending on the distance from the axis of rotation. The reason for this is that the distance along which the wood is advanced between two consecutive chipper knives should be the same though the distance between them along a radial line varies with varying radial distances from the axis of rotation. For example, in the case of a tool in the form of a plane disc, the ideal cam curve is rectilinear, as seen in cross-section, along one and the same radial distance from the axis of rotation, but the angle to a plane of rotation increases with decreasing radial distance from the axis of rotation. On the other hand, in the case of a conical chipper disc, the ideal cam curve is arched with a radius of curvature that decreases with decreasing radial distances from the axis of rotation.

The cutting edges of the chipper knives for such chippers are formed between two surfaces shaped by grinding or in any other way, a first surface or timber-guiding surface facing outwards towards the pieces of timber that are fed to the tool for cutting, while a second surface or chip-guiding surface faces inwards towards an opening formed in the tool and is adapted to guide the chips into the opening so that the chips can be discharged through the tool for direct use or intermediate storage. Consequently, the outwardly oriented timber-guiding surface of the cutting edge will form part of the cam curve that is adapted to guide the pieces of wood to the following chipper knife. Thus, the timber-guiding surface of the chipper knife should follow the ideal cam curve as closely as possible.

However, the chipper knives, in particular their cutting edges, are subjected to considerable wear, which means that it is also important that they should be made as inexpensive and simple as possible, so that they can be replaced and/or resharpened at a low cost. It is therefore quite common for the chipper knife to have a plane timber-guiding surface with a constant angle along the whole length of the chipper knife. As a rule, however, it is made as short as possible in order to interfere as little as possible with the feeding of the pieces of timber. A common type of chipper knife thus has an essentially flat shape with two large main surfaces, and the cutting edge is formed between one of the main surfaces and a bevelled surface between the main surfaces, the bevelled surface forming the timber-guiding surface, while the edge-forming main surface forms a chip-guiding surface.

The principles outlined above are known from U.S. Pat. No. 2,183,224, which thus discloses a chipper in which the edge-forming timber-guiding surface of the chipper knife has a shape that essentially corresponds to the ideal cam curve. In this case, the timber-guiding surface is formed by one of the main surfaces of the chipper knife, while the chip-guiding surface is formed by the bevelled surface between the two opposite main surfaces. However, this type of chipper and chipper knife has never been very commercially successful. Possibly because, on the one hand, the chipper knives are too expensive to manufacture and, on the other hand, the improvement in chip quality and the resulting increase in revenue have not been enough to compensate for the increased costs of the machine and the chipper knives.

SE 419,522 discloses a chipper in which a twisted timber-guiding surface is provided with a varying angle relative to the direction of rotation depending on the distance from the axis of rotation. In this case, this is achieved by using plane and straight inner knife holders, chipper knife and outer knife holders which are twisted by clamping them against a non-plane support. A drawback of a chipper of this kind is, however, that very large forces are required to deform the knife holder elements and the chipper knife, which means that mounting the chipper knives is very time-consuming. Moreover, when fixing the knife holder elements and the chipper knife in the twisted shape tension is built into the material, which makes them more susceptible to damage during operation.

SUMMARY OF THE INVENTION

One object of the invention is to provide, in a simple and inexpensive manner, a chipper knife which allows cutting of chips of a more uniform size, and in particular of a more uniform thickness, than is possible using conventional chipper knives according to prior art, while reducing especially the amount of oversized chips. Another object is to allow operation of a chipper, equipped with such chipper knives, at a low power consumption and with little wear. At least these objects are achieved by means of a chipper knife according to claim 1.

A further object of the invention is to provide a chipper knife which has the above properties, but which nevertheless is such that it can be turned end-for-end to allow the effective operating time for each chipper knife to be extended. This object is achieved by means of a chipper knife according to claim 2.

The invention is thus based on the understanding that the chip quality, i.e. the uniform shape of the chips, such as the uniform length of the chips and, in particular, the uniform thickness of the chips with a reduction of the amount of oversized chips, can be considerably improved by providing a chipper knife having a twisted edge-forming timber-guiding surface with a cutting edge whose edge angle is constant, i.e. with a correspondingly twisted chip-guiding surface.

The invention is applicable to all types of disc-shaped or conical chippers, i.e. in such chippers where the cutting edges of the chipper knives have a certain radial extension relative to the axis of rotation. By designing the chipper knives according to the invention a more uniform thickness of the cut chips is obtained regardless of where along the cutting edge of the chipper knife the cuts are performed. The scientific explanation for this is that the chips are severed from the pieces of timber by a force normal to the chip-guiding surface of each chipper knife acting on the wood. Furthermore, wood is about eight times more resistant to forces acting in parallel to the fibre direction than perpendicularly thereto. It is thus advantageous if the angle between the chip-guiding surface and the fibre direction, the so-called residual angle, is as large as possible, preferably larger than 90°, for the normal force from the chip-guiding surface to have as large a component as possible perpendicularly to the fibre direction. A small residual angle implies a number of drawbacks. For example, the severed chips have a greater thickness since the wood is harder to cut, a greater force will be required to operate the chipper leading to increased power consumption and wear, and there is a risk that the end edges of the chips are upset, which means that individual fibres are broken off, thus making the chips less suitable as raw material for the production of pulp.

The above reasoning regarding the residual angle between the chip-guiding surface of the chipper knife and the fibre direction is generally applicable to all kinds of chipping, and prior-art chipper knives for conical or plane chipper discs are characterised in that the residual angle decreases outwardly towards the periphery of the disc, which results in a corresponding decrease in chip quality. In the case of plane chipper discs the change in residual angle is relatively small between the inner and outer portions of the cutting edge. Such chipper discs are used to turn whole pieces of timber into chips, in which case it is possible to feed the timber obliquely to the plane of the disc, in such a way that it is often possible to obtain a sufficiently favourable residual angle also in the peripheral area of the disc. As regards conical chipper discs, the conditions are somewhat less favourable since the discs are arched and, in addition, the feeding of the pieces of timber is more restricted since such chipper discs are used for log reduction, i.e. planing of a log for the purpose of forming a block. Moreover, it is often desirable to mount the chipper knives slightly offset in such chippers, i.e. the chipper knives are inclined relative to a plane radial to the axis of rotation in such manner that the outer end of the chipper knife is located ahead of the inner end as seen in the direction of rotation. This is done, inter alia, to ensure a smoother operation of the chipper by preventing the cutting edge from making contact with the piece of timber along its whole longitudinal extension at the same time. The offset position of the chipper knives results in the residual angle being further reduced towards the outermost end of the chipper knife.

However, there is yet another aspect that influences the resultant residual angle, viz. that the cutting edge angle, i.e. the angle between the timber-guiding surface and the chip-guiding surface of the chipper knife, has to be large enough for the cutting edge to withstand the loads to which it is subjected. As a rule, the cutting edge angle should be about 30–32°. The invention is thus based on the understanding that if the timber-guiding surface of the chipper knife is given a twisted shape, so that it follows the ideal cam curve as closely as possible, there is scope for giving the chip-guiding surface a twisted shape as well, i.e. forming the chipper knife with an essentially constant cutting edge angle, thereby improving the residual angle in the outer end portions of the cutting edge.

It has been found that in chipper knives according to U.S. Pat. No. 2,183,224, in which the timber-guiding surface of the chipper knife has a twisted shape, while the chip-guiding surface is plane making a constant angle to the direction of rotation along the whole length of the chipper knife, the part of the cutting edge of the chipper knife that is located closest to the axis of rotation, and that has a smaller cutting edge angle, will cut chips of a smaller average thickness than the part of the chipper knife that is located furthest away from the axis of rotation and that, thus, has a larger cutting edge angle. Since the cutting edge of the chipper knife, according to the invention, will have a constant and advantageously small cutting edge angle along its whole length, and thus also a greater residual angle in mounted state during operation in the chipper, the amount of oversized chips will be reduced and less force will be required to operate the machine leading to reduced power consumption and wear. When selling chips for pulp production the maximum price is obtained for so called acceptable chips, the size of which is within a predetermined size range. All chips of sizes falling outside of this range are screened out or sold at a lower price. The percentage of acceptable chips from a chipper is usually in the range of about 70–80%. A one percent increase the share of acceptable chips can mean a considerable increase in revenue for a sawmill or a producer of pulp.

According to a preferred embodiment of the invention, the chipper knife has an essentially flat shape and both the timber-guiding surface and the chip-guiding surface, which form the cutting edge of the chipper knife, are obtained by means of bevel grinding relative to respectively the outer and the inner main surface of the chipper knife. This allows both the timber-guiding surface and the chip-guiding surface, which both have a twisted shape that is relatively complicated from the point of manufacture, to be made with a small cross-sectional extension, which minimizes the amount of complex machining required. However, it will be appreciated that the invention is applicable also in the case of chipper knives, in which one of the timber-guiding or chip-guiding surface is formed by one of the main surfaces of the chipper knife. This implies, however, a considerable increase in the amount of machining required. It will further be appreciated that the invention is applicable to other types of chipper knives than those of an essentially plane shape, such as a chipper knife of the kind shown in Applicant's WO 02/06022. Moreover, in the preferred embodiment, both the timber-guiding surface and the chip-guiding surface have a cross-sectionally rectilinear extension. However, it would be perfectly possible to make, for example, the timber-guiding surface with an arched cross-sectional shape for conical chippers to allow the timber-guiding surface to better follow the ideal cam curve between two chipper knives.

In the following example, the invention is used in connection with a "reducer" which has two opposite frustoconical chipper discs on which the chipper knives are arranged in two separate circumferential rings at different radial distances from the axis of rotation, four chipper knives being provided in each circumferential ring. In the working example, all the chipper knives, i.e. both in the inner and the outer circumferential rings, are formed according to the invention, i.e. with twisted timber-guiding surfaces and chip-guiding surfaces. However, to simplify the design and reduce the number of chipper knife designs required it would be possible to make only the inner circumferential ring of chipper knives with twisted timber-guiding and chip-guiding surfaces, while the outer circumferential ring of chipper knives has conventional plane timber-guiding and chip-guiding surfaces making a constant angle to the direction of rotation along their whole length. The design of the cutting edge of the outer circumferential ring of chipper knives is then suitably such that it corresponds to the outer end of the inner circumferential ring of chipper knives. The reason for this is that in a chipper or reducer of this kind the machining of the logs is performed mainly by the inner circumferential ring of chipper knives, whereas the chipper knives in the outer circumferential ring are active only in the case of very thick or bent logs. The amount of chips cut by the outer circumferential ring of chipper knives is therefore small and the effect on the average chip size is practically negligible.

When applying the invention to a reducer with two opposite chipper discs, the chipper knives must be made in a left-hand version and a right-hand version, since the shape of the cutting edges will be mirror-inverted depending on whether they are intended for the left or the right chipper disc.

According to a particularly preferred embodiment, the chipper knife is symmetrical about a plane perpendicular to the chipper knife and through its centre. Such a design affords the additional advantage of allowing the chipper knife to be turned end-for-end, i.e. when the inner end of the cutting edge of the chipper knife, which end is located closest to the axis of rotation and subjected, during cutting, to the greatest wear, is worn to such a degree that its cutting properties have been considerably reduced, the chipper knife can be turned end-for-end in such manner that the end that was previously facing outwards and located furthest away from the axis of rotation is disposed closest to the axis of rotation. This allows optimal exploitation of the operational life of the chipper knife. It would also be possible to apply the invention to a chipper knife having two opposite, twisted cutting edges, i.e. to make the chipper knife symmetrical also about a plane parallel to its longitudinal extension and through its centre. This allows the chipper knife to be turned so that the previously inactive cutting edge is positioned for cutting chips. The chipper knifes can be either resharpenable or directly replaceable when worn.

DETAILED DESCRIPTION OF A PREFERRED EMBODIMENT OF THE INVENTION

Figure 1:
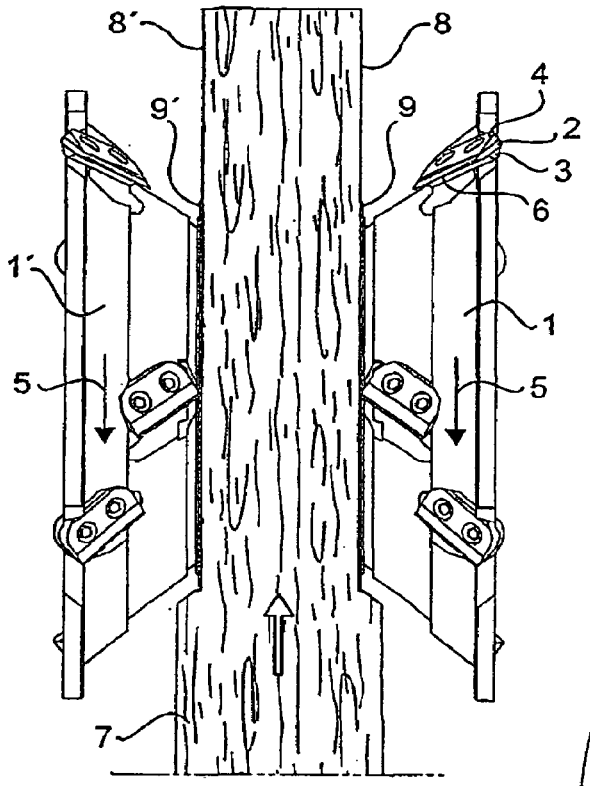
FIG. 1 is a top plan view of a chipper in the form of a reducer having two opposite, frustoconical rotatable chipper discs, between which a log is advanced in the longitudinal direction.

An embodiment of the invention will be described below in connection with a chipper in the form of a reducer which, as shown schematically in FIG. 1, comprises two frustoconical chipper discs 1, 1'. A plurality of chipper knives 2 are mounted along the lateral areas of the chipper discs and retained between an inner clamping member 3 and an outer clamping member 4, as shown in more detail in FIGS. 7 and 8. The chipper discs are rotatable in the direction indicated by the arrows 5 and by orienting cutting edges 6 of the chipper knifes in the direction of rotation it is possible to plane a round log 7 advanced between the chipper discs into a block with two plane side surfaces 8, 8' by cutting the material to be removed into chips. At the top or narrow end of the frustoconical chipper disc 1, 1', a saw blade 9, 9' is arranged to give a finishing cut to the block surfaces 8, 8'.

Figure 2:
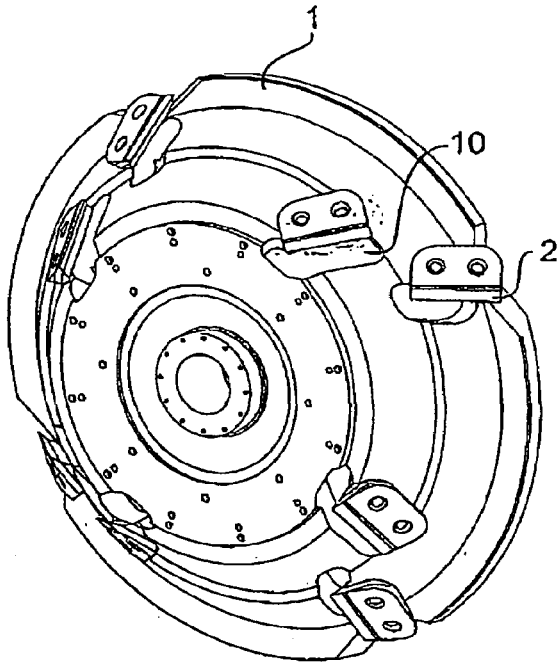
FIG. 2 is a perspective view of one of the chipper discs in FIG. 1.

The right-hand chipper disc 1 in FIG. 1 is shown in a perspective view in FIG. 2, but with the saw blade removed. As shown, a through hole 10 is formed in the chipper disc in the area in front of each chipper knife 2. The purpose of the holes 10 is to allow the chips cut from the log 7 by the chipper knives 2 to pass through the chipper disc to be forwarded via a pipe system to a storage facility or to be used directly.

During cutting the timber will therefore abut against and be guided by the outside of the lateral area of the frustoconical chipper disc. To ensure a smooth and shock-free feeding of the timber, the timber-guiding surface should follow as closely as possible an ideal cam curve, which falls away continuously and constantly radially inwards towards the axis of rotation from one chipper knife cutting edge to the following chipper knife cutting edge. In this way, the wood is advanced the same distance between each chipper knife, thereby ensuring chips of uniform length.

Figure 3:
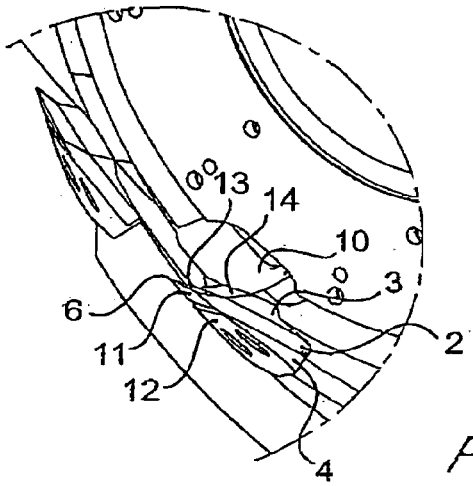
FIG. 3 is a detailed view in enlarged scale of a portion of the chipper disc in FIG. 2.

FIG. 3 is an enlarged view of a portion of FIG. 2 and illustrates two chipper knives 2 that are fixed between inner 3 and outer 4 clamping members. The cutting edge 6 of the chipper knife is formed between two bevelled surfaces, the outwardly oriented surface 11 of which, like the outwardly oriented surface 12 of the outer clamping member, forms part of the timber-guiding surface between two consecutive chipper knives. The inwardly oriented, edge-forming surface 13, like a front surface 14 of the inner clamping member 3, forms part of a chip-guiding surface that guides the chips through the opening 10.

Figure 4:
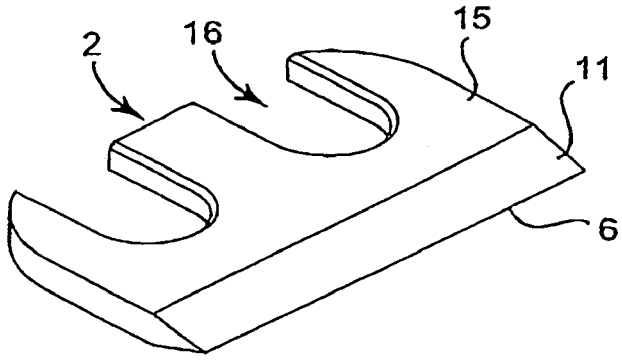
FIG. 4 is a perspective view of an individual chipper knife in the reducer according to FIGS. 1–3.
Figure 5:
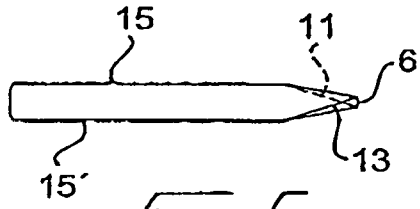
FIG. 5 is a side view of the chipper knife according to FIG. 4.
Figure 6:
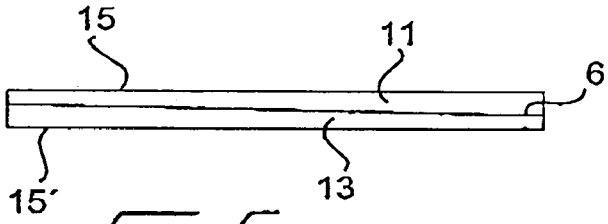
FIG. 6 is a front view of the cutting edge of the chipper knife according to FIG. 4.

FIGS. 4–6 show the design of an individual chipper knife in more detail, the chipper knife being shown in a perspective view, a side view and a front view. As shown, the chipper knife has an essentially flat shape with two opposite main surfaces 15, 15' and the cutting edge is formed at the front edge of the chipper knife between two bevelled surfaces, which, when mounted in the chipper, will act as timber-guiding surface 11 and chip-guiding surface 13, respectively, as described above.

As is best shown in FIGS. 5 and 6, both the timber-guiding surface 11 and the chip-guiding surface 13 are twisted in such manner that in the left edge portion in FIG. 6, which is intended to be located closest to the axis of rotation of the chipper disc, the timber-guiding surface 11 makes a relatively small angle to the upper main surface 15, whereas the chip-guiding surface 13 makes a relatively large angle to the lower main surface 15'. In the opposite, right end portion of the chipper knife, which is intended to be located furthest away from the axis of rotation of the chipper disc, the timber-guiding surface 11 makes a relatively large angle to the upper main surface 15, whereas the chip-guiding surface 13 makes a relatively small angle to the lower main surface 15'. The angles between respectively the timber-guiding surface 11 and the chip-guiding surface 13 and the main surfaces 15, 15' are adapted in such manner that the cutting edge angle, i.e. the angle between the timber-guiding surface 11 and the chip-guiding surface 13, is constant along the whole length of the chipper knife. In a preferred embodiment the edge angle is suitably in the range of about 30–32°.

The chipper knife shown and described in the working example is symmetric about a plane perpendicular to its longitudinal extension and through its centre. This allows the chipper knife to be turned end-for-end in such manner that the surface which, in a first operating position, acts a timber-guiding surface 11, will act, in a second operating position, as chip-guiding surface 13, and vice versa.

Figure 7:
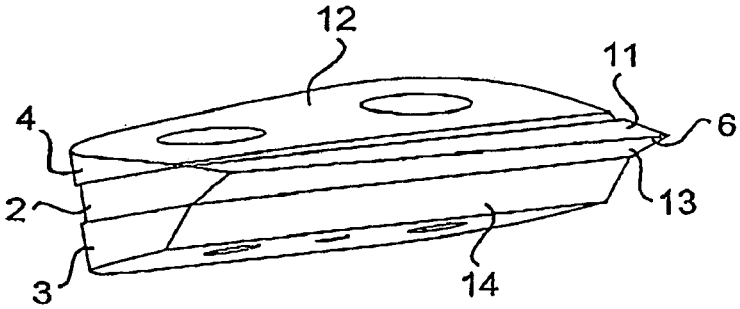
FIG. 7 is a perspective view of the chipper knife according to FIGS. 4–6, located between an inner and an outer clamping member.
Figure 8:
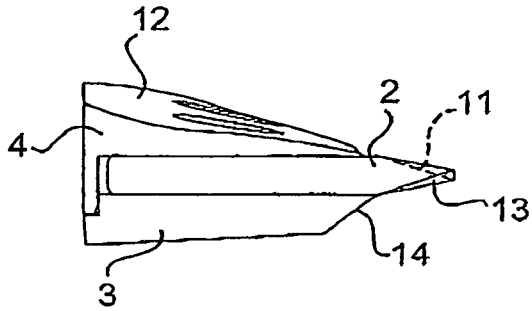
FIG. 8 is a side view of the chipper knife and the clamping member according to FIG. 7.

FIGS. 7 and 8 show the chipper knife 2 when fixed between an inner and an outer clamping member respectively 3 and 4. Since the outwardly facing surface 12 of the outer clamping member 4 will also act as a timber-guiding surface, it is twisted in accordance with the timber-guiding surface 11 of the chipper knife. The front edge 14 of the inner clamping member 3 can, if desired, also be twisted so that the pieces of timber are guided as smoothly as possible. As shown in FIGS. 1 and 2, the chipper knives are not positioned in such manner that the cutting edges extend in a plane parallel to the axis of rotation, but rather so that they are slightly turned or offset, in such manner that the outermost end of the cutting edges, which is located furthest away from the axis of rotation, is arranged slightly ahead of the inner ends of the cutting edges, which are located closest to the axis of rotation, as seen in the direction of rotation. This has been taken into consideration when designing the timber-guiding surface 11 and chip-guiding surface of each chipper knife, so that the timber-guiding surface follows as closely as possible the ideal cam curve. In the embodiment shown, the chipper knives have a cutting edge length of about 300 mm and considering the size of the chipper disc, the desired chip size and the inclination of the chipper knives relative to a plane parallel to the axis of rotation, the angle difference between the inner and outer ends of the timber-guiding surfaces 11 and chip-guiding surfaces, respectively, of the chipper knives will be about 8–10°. However, this may vary greatly depending on the particular conditions that apply in each individual case.

The invention claimed is:

1. A chipper knife for use in a rotating wood chipper disk, said knife comprising a knife body having first and second opposed body surface portions, at least one cutting edge having first and second ends, and first and second angularly related guiding surfaces which extend at angles to said first and second body surface portions respectively and intersect to define said cutting edge, said first guiding surface having a varying angle along its length in relation to its associated first body surface portion with the angle adjacent said first end being greater than the angle at the second end and continually decreasing from said first to said second end; said second guiding surface having a varying angle along its length in relation to its associated second body surface portion with the angle adjacent the first end being smaller than the angle at the second end and continually increasing from said first to said second end, whereby the cutting edge angle between the guiding surfaces is essentially constant along the length of the cutting edge while the cutting edge is closer to said second body surface portion at said first end of the cutting edge than it is at the second end.

2. The chipper knife as defined in claim 1 wherein said first guide surface is a timber guide surface and said second guide surface is a chip guiding surface.

3. A chipper knife as defined in claim 1 wherein the cutting edge angle and the distance of the cutting edge from the first body surface portion at the first end of the cutting edge and its distance from the second body surface portion at its second end are symmetrical whereby the knife may be mounted in the chipper disk in either of two positions.

4. A chipper knife as claimed in claims 1, 2 or 3 wherein said guiding surfaces are rectilinear in cross-section.

5. A wood chipper disk including a disk body adapted for rotational mounting in a wood chipper including a peripheral knife mounting surface, a plurality of wood chipping knives and means for mounting said wood chipping knives on said knife mounting surface; said knives each having first and second opposed body surface portions, at least one cutting edge having first and second ends, and first and second angularly related guiding surfaces which extend at angles to said first and second body surface portions respectively and intersect to define said cutting edge, said first guiding surface having a varying angle along its length in relation to its associated first body surface portion with the angle adjacent said first end being greater than the angle at the second end and continually decreasing from said first to said second end; said second guiding surface having a varying angle along its length in relation to its associated second body surface portion with the angle adjacent the first end being smaller than the angle at the second end and continually increasing from said first to said second end, whereby the cutting angle between the guiding surfaces is essentially constant along the length of the cutting edge while the cutting edge is closer to said second body surface portion at said first end of the cutting edge than it is at the second edge, and said knives being mounted by said mounting means with said cutting edges oriented in the direction of rotation of the chipper disk and with said second end of each of the knives being closer to the axis of rotation of the cutter disk than said first ends whereby the first guiding surface follows as closely as possible an ideal timber-guiding cam curve between consecutive chipper knives and the chipper knife cutting edge has a varying angle along its length in relation to a plane of rotation of the disk such that the angle is greater at the end of the cutting edge closest to the axis of rotation and decreases in the outward direction.

6. A wood chipper disk as defined in claim 5 wherein said first guide surface is a timber guide surface and said second guide surface is a chip guiding surface.

7. A wood chipper disk as defined in claim 5 wherein the cutting edge angle and the distance of the cutting edge from the first guiding surface at the first end of the cutting edge and its distance from the second guiding surface at its second end are symmetrical whereby the knife may be mounted in the chipper disk in either of two positions.

8. A wood chipper disk as defined in claims 5, 6, or 7 wherein said guiding surfaces are rectilinear in cross-section.

9. A chipper knife for use in a rotating wood chipper disk, said knife comprising a knife body having first and second opposed body surface portions, at least one cutting edge having first and second ends, and first and second angularly related guiding surfaces which extend at angles to said first and second body surface portions respectively and intersect to define said cutting edge, said first guiding surface having a varying angle when viewed in cross-section along its length in relation to its associated first body surface portion with the angle adjacent said first end of the cutting edge being greater than the angle at the second end and continually decreasing from said first to said second end; said second guiding surface having a varying angle when viewed in cross-section along its length in relation to its associated second body surface portion with the angle adjacent the first end of the cutting edge being smaller than the angle at the second end and continually increasing from said first to said second end, whereby the cutting edge angle defined between the guiding surfaces is essentially constant along the length of the cutting edge while the cutting edge is closer to said second body surface portion at said first end of the cutting edge than it is at the second edge.

10. A wood chipper disk including a disk body adapted for rotational mounting in a wood chipper including a peripheral knife mounting surface, a plurality of wood chipping knives and means for mounting said wood chipping knives on said knife mounting surface; said knives each having first and second opposed body surface portions, at least one cutting edge having first and second ends, and first and second angularly related guiding surfaces which extend at angles to said first and second body surface portions respectively and intersect to define said cutting edge, said first guiding surface having a varying angle when viewed in cross-section along its length in relation to its associated first body surface portion with the angle adjacent said first end of the cutting edge being greater than the angle at the second end and continually decreasing from said first to said second end; said second guiding surface having a varying angle when viewed in cross-section along its length in relation to its associated second body surface portion with the angle adjacent the first end of the cutting edge being smaller than the angle at the second end and continually increasing from said first to said second end, whereby the cutting angle defined between the guiding surfaces is essentially constant along the length of the cutting edge while the cutting edge is closer to said second body surface portion at said first end of the cutting edge than it is at the second edge, and said knives being mounted by said mounting means with said cutting edges oriented in the direction of rotation of the chipper disk and with said second end of each of the knives being closer to the axis of rotation of the cutter disk than said first ends whereby the first guiding surface follows as closely as possible an ideal timber-guiding cam curve between consecutive chipper knives and the chipper knife cutting edge has a varying angle along its length in relation to a plane of rotation of the disk such that the angle is greater at the end of the cutting edge closest to the axis of rotation and decreases in the outward direction.

* * * * *